United States Patent [19]

Drozdov

[11] 4,433,270

[45] Feb. 21, 1984

[54] REVERSIBLE PERIODIC MAGNETIC FOCUSING SYSTEM

[76] Inventor: Sergei S. Drozdov, ulitsa Narodnogo Opolchenia, 24, korpus 1, kv. 104; Mikhail V. Kiselev Dmitriev, Domodedovskaya ulitsa, 11, Korpus, Kv. 12; Sergei V. Lebedinsky, Profsojuznaya ulitsa, 46, Korpus 2, Kv. 31; Sergei N. Nazarov, ulitsa Dnepropetrovskaya, 23, Korpus 3, Kv. 47; Jury V. Lavrentiev, ulitsa Kakhovka, 10/12, Korpus 1, Kv. 21; Pavel V. Nevsky, Profsojuznaya ulitsa, 49, Korpus 1, Kv. 89; Nina V. Kutasheva, ulitsa Bolshaya Gruzinskaya 20, Kv. 16, all of Moscow, U.S.S.R.

[21] Appl. No.: 293,627

[22] PCT Filed: Jan. 28, 1980

[86] PCT No.: PCT/SU80/00008

§ 371 Date: Aug. 17, 1981

§ 102(e) Date: Aug. 17, 1981

[87] PCT Pub. No.: WO81/02221

PCT Pub. Date: Aug. 6, 1981

[51] Int. Cl.³ ..... H01J 23/08

[52] U.S. Cl. ..... 315/5.35; 313/442; 315/5.37; 315/5.39

[58] Field of Search ..... 313/153, 414, 442; 315/5.34, 5.35, 5.37, 5.39

[56] References Cited

U.S. PATENT DOCUMENTS

| | | | |
|---|---|---|---|
| 2,305,884 | 12/1942 | Litton | 315/5.35 |
| 3,020,440 | 2/1962 | Chang | 313/153 X |
| 3,021,447 | 2/1962 | Jepsen et al. | 315/5.37 X |
| 3,172,008 | 3/1965 | Schmidt | 313/153 X |
| 3,237,059 | 2/1966 | Meyerer | 315/5.35 X |
| 3,329,915 | 7/1967 | Meyerer | 315/5.35 X |
| 3,665,242 | 5/1972 | Dubravec | 315/5.34 |

FOREIGN PATENT DOCUMENTS

| | | | |
|---|---|---|---|
| 661642 | 5/1979 | U.S.S.R. | 315/5.35 |

*Primary Examiner*—Saxfield Chatmon, Jr.
*Attorney, Agent, or Firm*—McAulay, Fields, Fisher, Goldstein & Nissen

[57] ABSTRACT

The reversible periodic magnetic focusing system according to the invention comprises a successive arrangement of permanent magnets 7 magnetized in the opposite sense, and pole shoes 1 interposed between the permanent magnets 7. Each pole shoe 1 is provided with a hole for passage of an electron flow. The holes of the pole shoes 1 receive grids 2 with meshes 3. The grids 2 are of a magnetically soft material and have a magnetic, thermal and electric contact with the pole shoes 1. Respective meshes 3 of the grids 2 are arranged coaxially.

The invention stipulates ratios between the geometrical dimensions of components of the reversible periodic magnetic focusing system, which ensure passage of electron beams 5 through all the meshes 3 of the grids 2.

The invention is applicable to the electronic industry where it can be used to design and manufacture, compact, low-voltage, superhigh frequency, high-power devices, such as klystrons and travelling wave tubes. The invention is also applicable to charged particle accelerators and equipment which makes use of extended electron flows.

17 Claims, 7 Drawing Figures

REVERSIBLE PERIODIC MAGNETIC FOCUSING SYSTEM

FIELD OF THE INVENTION

The present invention relates to vacuum tubes and, more particularly, to a reversible periodic magnetic focusing system.

REVIEW OF THE PRIOR ART

Superhigh frequency tubes, such as klystrons and travelling wave tubes find extensive application in different branches of the economy in many countries. The factors that hinder their application are their great weight and the necessity of using high voltage sources. The weight of such tubes and their anode voltage are largely determined by the weight of the focusing system and the perveance of the electron flow. Light-weight focusing systems capable of forming high-perveance electron flows are an indispensable condition for the provision of light, low voltage superhigh frequency tubes.

At present use is made of different types of focusing systems.

There are known magnetic focusing systems (cf. U.S. Pat. No. 3,475,644, Cl. 315-35, of Oct. 28, 1969) of the type that comprises a solenoid with pole shoes mounted on its end faces. As the solenoid is excited, a uniform magnetic field is produced between the pole shoes, which provides for the transportation of a high-perveance flow exiting from a gun.

Such focusing systems are disadvantageous in that they have a great weight and size and require a special power source.

There are known focusing systems which use a permanent magnet instead of a solenoid to produce a uniform magnetic field over the entire length of the system (cf. G. Merdinian and J. V. Lebacqs, "High Power, Permanent Magnet Focused, S-Band Klystron for Linear Accelerator Use" in Proc. 5th Int. Conf. on Hyperfrequency Tubes, Paris, France, Sept. 1964).

Such systems require no special power source, but suffer from a great weight and size.

There are known electrostatic focusing systems (cf. U.S. Pat. No. 3,436,588, Cl. 3155.39, of Apr. 1, 1969) comprising a plurality of single electrostatic lenses arranged between the resonators of the klystron. Such systems have a small weight and size and require no special power source.

However, electrostatic systems do not provide for a sufficiently strong focusing; the perveance of the electron flow focused by such systems is never higher than $1 \cdot 10^{-6}$ $A/B^{3/2}$.

There is known a reversible periodic magnetic focusing system (cf. FRG Pat. No. 1,190,708, Cl. 21 g 13/17, of December 1965) comprising a plurality of successively arranged pole shoes with a central hole for the passage of an electron flow. Permanent magnets are used to produce a uniform variable-polarity (reversible) magnetic field between the pole shoes.

The focusing of such a system is stronger than that of an electrostatic system; the latter system is also advantageous in that it makes it possible to reduce the weight of the magnet by $(n+1)$ times, as compared to the system with a uniform magnetic field, where n is the number of field reversals.

However, reversible magnetic systems can only operate at a small perveance of the electron flow. This is due to the presence of a reversal zone in which the magnetic field is weak. The extension of this zone is commensurable with the diameter of the hole provided in the pole shoe. As a high-perveance electron flow passes through the reversal zone, it gets out of focus and its further formation is disturbed.

BRIEF DESCRIPTION OF THE INVENTION

It is an object of the present invention to increase the perveance of the electron flow formed by a reversible periodic magnetic focusing system.

The invention essentially aims at providing a reversible periodic magnetic focusing system which would reduce the extension of the reversal zone by several tens of times and would ensure the transportation of a high-perveance electron flow due to an improved pole shoe design.

The foregoing object is attained by providing a reversible periodic magnetic focusing system comprising a successive array of permanent magnets magnetized in the opposite sense, and magnetically soft pole shoes interposed between the permanent magnets, each pole shoe having a hole for the passage of an electron flow, the system being characterized, in accordance with the invention, in that the holes of the pole shoes receive grids with meshes, the grids being of a magnetically soft material and having a magnetic, thermal and electric contact with the pole shoes, the respective meshes of the grids of the pole shoes being arranged coaxially.

The periodic magnetic focusing system according to the invention reduces the extension of the reversal zone of the magnetic field several tens of times and proportionately increases the perveance of the electron flow formed by the system.

It is advisable that the pole shoes and meshes of the grids should be round, and that the flat pole shoes should be provided on each side with annular projections with radially magnetized ring magnets attached thereto, the dimensions and thickness of the grids, the distance between the pole shoes, the diameter of the meshes of the grids, the diameter of the pole shoes and the size of the projections being selected so as to meet the following conditions:

$$0.8 \leqq (a/t) \leqq 1.3 \quad (1)$$

$$1 \geqq (3/4)R(B/B_1); \quad (2)$$

$$0.05 \leqq (h/L) \leqq 0.15; \quad (3)$$

$$(d/L) \leqq 0.6 \quad (4)$$

$$0.8 \leqq (D/L). \quad (5)$$

where a is the diameter of the meshes of the grids;

t is the grid thickness;

l is the aximuthal distance between the nearest holes which are equidistantly spaced from the centre of the pole shoes;

R is the distance between the centre of a mesh of a grid and the centre of the pole shoe;

B is the induction in the gap between the pole shoes;

$B_1$ is the maximum induction of the linear portion of the magnetization curve of the pole shoe material;

h is the height of the projections;

L is the distance between the pole shoes;

D is the outer diameter of the pole shoes.

Meeting the above conditions ensures a uniform magnetic field in each mesh of the grid and throughout the spacing between the pole shoes. This, in turn, provides conditions for the correct formation of the electron flow by all the meshes of the grids.

Each pole shoe can be shaped as a polyhedron with parallelepiped-shaped, longitudinally magnetized permanent magnets arranged radially on the faces of the polyhedron.

Such a design considerably facilitates the magnet manufacture.

It is expedient that the grids of the pole shoes should have a honeycomb structure with hexagonal meshes.

This makes it possible to improve the transparence of the grids and raise the perveance of the electron flow focused by the system.

The pole shoes may be shaped as rectangular plates, in which case two axially magnetized permanent magnets are arranged one opposite the other between the pole shoes, the permanent magnets arranged in the gap between pole shoes being displaced in the azimuthal direction by 90° with respect to the permanent magnets arranged in the next gap.

This intensifies the magnetic field and improves its uniformity; such as arrangement also facilitates the location of the power input and output means and provides a ready access to the means for adjusting the resonator of the klystron and to the resonator unit cooling system.

The pole shoes may be constructed as cross-shaped plates, in which case four axially magnetized, prism-shaped permanent magnets are arranged between the ends of the cross, the magnets having a polyhedral cross-section.

This shape of the permanent magnets provides enough space for the location of the power input and output means and for a ready access to the resonator adjustment means.

BRIEF DESCRIPTION OF THE ACCOMPANYING DRAWINGS

DESCRIPTION OF THE PREFERRED EMBODIMENTS

Figure 1:
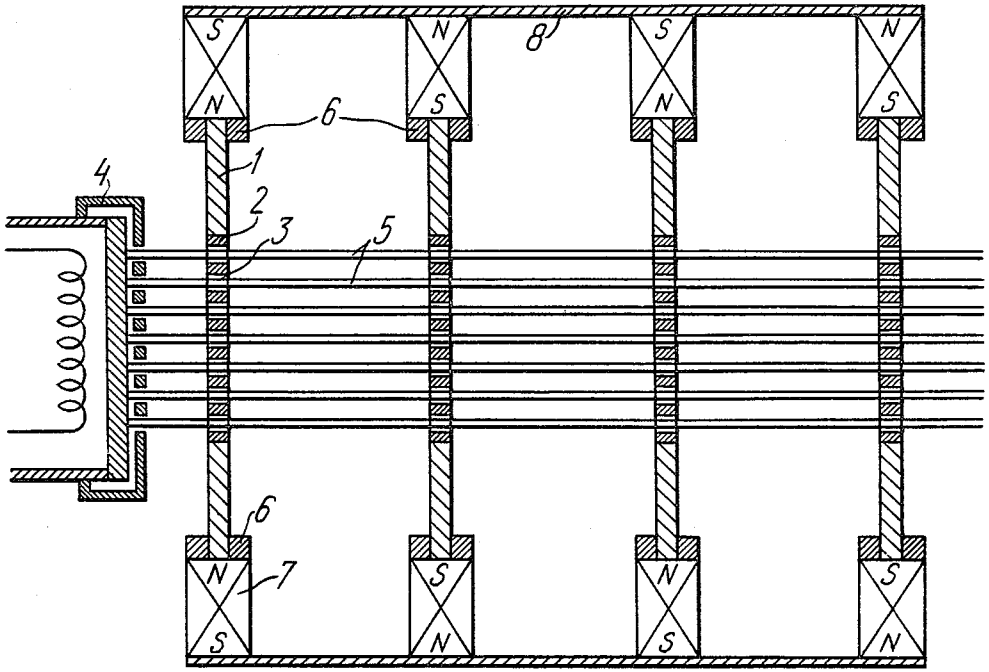
FIG. 1 is a schematic view of a reversible periodic magnetic focusing system in accordance with the invention.
Figure 2:
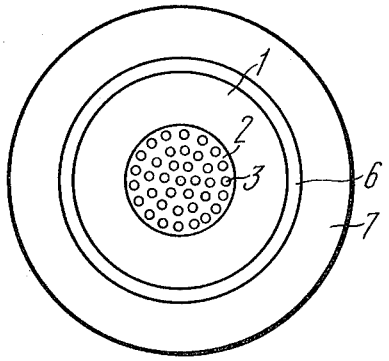
FIG. 2 is a view of a pole shoe with round meshes of the grid.

The reversible periodic magnetic focusing system according to the invention comprises pole shoes 1 (FIGS. 1 and 2) into which there are installed grids 2 with meshes 3 arranged coaxially with the outlet holes of a multibeam electron gun 4. Electron beams 5 of the multibeam electron flow of the gun 4 pass through the meshes 3. On each side, the pole shoes 1 are provided with annular projections 6 on which there are mounted ring permanent magnets 7 magnetized in the radial direction and producing a reversible magnetic field. The permanent magnets 7 are interconnected by a magnetic circuit 8 of a magnetically soft material.

As the grids 2 are introduced into the holes of the pole shoes 1, all the meshes 3 of the grids 2, with the exception of the central mesh, are displaced with respect to the geometrical centres of the pole shoes 1. This affects the axial symmetry of the magnetic field in the displaced meshes 3 and impairs the focusing of the electron beams 5.

The lack of symmetry of the magnetic field can be ruled out by providing a uniform magnetic field in the gaps between the grids 2 and by making the radial component of the magnetic field independent of the azimuthal displacement angle of each mesh 3 of the grids 2.

The uniformity and distribution of the magnetic field in the gaps between the grids 2 are determined by the ratio between the height of the projections 6, the diameter of the pole shoes 1 and the distance between adjacent pole shoes.

With an increased height of the projections 6, the induction of the magnetic field increases towards the middle of the gap between the pole shoes 1, and the lines of force of the magnetic field are saddle-shaped. With a small height of the projections 6, the induction of the magnetic field decreases towards the middle of the gap between the pole shoes 1, and the lines of force of the magnetic field are barrel-shaped. A uniform magnetic field can only be produced between the grids 2 with an optimum height of the projections 6, which can be determined through computerized calculation of the magnetic system.

The uniformity of the magnetic field between adjacent pole shoes 1 is also dependent upon the diameter of the pole shoes 1 and suffers from a decrease of that diameter. After the diameter of the pole shoes 1 is reduced to a certain value, the uniformity of the magnetic field can no longer be improved by adjusting the height of the projections 6. For this reason, the diameter of the pole shoes 1 must be greater than a certain threshold value.

The magnetic field between the grids 2 becomes less uniform towards the peripheral meshes 3, for which reason the diameter of the grids 2 must be less than a certain threshold value.

An optimum height of the projections 6 and threshold values of the diameter of the pole shoes 1 and the diameter of the grids 2 can be established experimentally or through computer-aided calculation. Experiments and calculations indicate that in order to obtain a uniform magnetic field in the gaps between the grids 2, the diameter D of the pole shoes 1, the diameter d of the grids 2, the distance L between adjacent pole shoes 1, and the height h of the projection 6 should be selected so as to meet the following conditions:

$$0.05 \leqq (h/L) \leqq 0.15,$$

$$0.8 \leqq (D/L),$$

$$(d/L) \leqq 0.6.$$

The radial component of the magnetic field can be made independent of the azimuthal displacement angle of each mesh 3 of the grids 2 by a correct selection of the aximuthal distance between the neighboring meshes 3 which are equidistantly spaced from the centre of the pole shoes 1, and by correctly selecting the thickness of the grids 2.

The azimuthal distance between the neighboring meshes 3 of the grids 2 determines the location of the operating point on the magnetization curve of the magnetically soft material of the grids 2. With a great azimuthal distance between neighboring meshes 3 of the grids 2, the operating point is on the linear portion of the magnetization curve of the material of the grids 2; in this case there is no saturation in the grids 2, and the radial component of the magnetic field is independent of the azimuthal displacement angle of the meshes 3 of the grids 2. As the azimuthal distance between adjacent meshes 3 of the grids 2 decreases, the operating point first moves to the non-linear portion of the curve and then to the portion corresponding to saturation of the material of the grids 2. In this case the radial component of the magnetic field is dependent on the azimuthal displacement angle of the meshes 3 of the grids 2. Thus in order to make the radial component of the magnetic field independent of the azimuthal displacement angle of each mesh 3 of the grids 2, the azimuthal distance between adjacent meshes 3 of the grids 2 must be greater than a certain threshold value.

The necessity to equalize the magnetic fluxes passing through the grids 2 and the gaps between adjacent pole shoes 1 suggests that the azimuthal distance 1 between adjacent meshes 3 of the grids 2, which are equidistantly, spaced from the centre of the pole shoes 1, should be selected so as to meet this condition:

$$1 \geqq (\tfrac{3}{4})R(B/B_1),$$

where

R is the distance between the centre of the mesh 3 of the grid 2 and the centre of the pole shoe 1;

B is the induction of the magnetic field produced by the magnets 7 in the gaps between adjacent pole shoes 1;

$B_1$ is the maximum induction of the linear portion of the magnetization curve of the material of the grids 2.

The thickness of the grids 2 also influences the dependence of the radial component of the magnetic field upon the azimuthal displacement angle of the meshes 3 of the grids 2. With thin grids 2, the material of the grids 2 is saturated to impair the focusing of the electron beams 5. If the thickness of the grids 2 is substantially greater than the diameter of the meshes 3, the reversal zone of the magnetic field is too extended in the meshes 3, which also impairs the focusing of the electron beams 5. In the optimum case, the diameter of the meshes 3 must be close to the thickness of the grids 2 and must meet this condition:

$$0.8 \leqq (a/t) \leqq 1.3,$$

where a is the diameter of the meshes 3;

t is the thickness of the grids 2.

Figure 3:
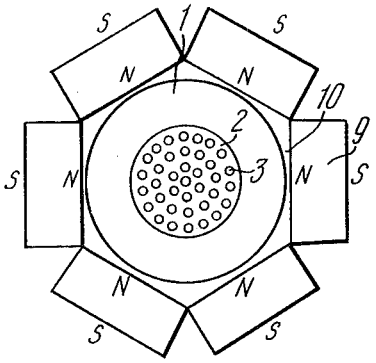
FIG. 3 is a view of a pole shoe with a polyhedron-shaped lateral surface.

In order to facilitate the fabrication of the reversible periodic magnetic focusing system, the radially magnetized ring permanent magnets may be replaced by longitudinally magnetized permanent magnets 9 (FIG. 3) shaped as parallelepipeds. In this case a pole shoe 10 is shaped as a polyhedron with the permanent magnets 9 mounted on its faces. It must be pointed out, however, that a replacement of the radially magnetized ring magnets 7 (FIGS. 1 and 2) by the longitudinally magnetized permanent magnets 9 (FIG. 3) reduces the induction of the magnetic field in the gaps between adjacent pole shoes by 10 to 20 percent.

Figure 4:
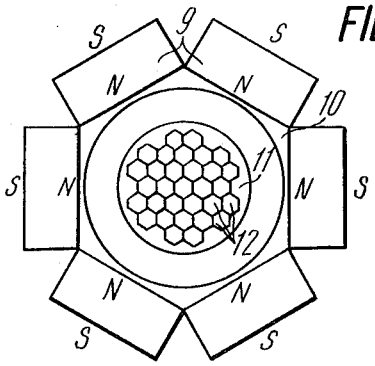
FIG. 4 is a view of the pole shoe of FIG. 3 with hexagonal meshes of the grid.

The perveance of the electron flow formed by the reversible periodic magnetic focusing system is dependent upon the number of the meshes 3 (FIGS. 1 and 2) in the grids 2; this number depends, in turn, upon the mesh packing density. In order to increase this density, the grids 2 with round meshes 3 are replaced by honeycomb-structured grids 11 (FIG. 4) with meshes 12 shaped as regular hexagons.

Figure 5:
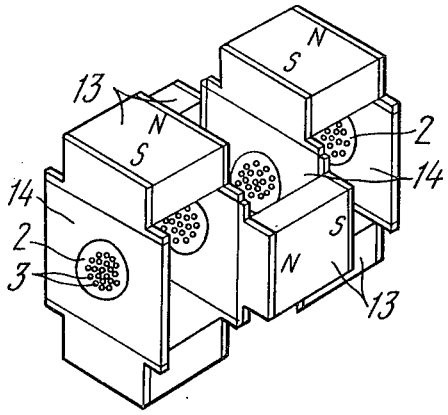
FIG. 5 is a schematic view of a reversible periodic magnetic focusing system in accordance with the invention with rectangular pole shoes.

As follows from the above ratios, the thickness of the projections 6 (FIGS. 1 and 2) and the thickness of the radially magnetized permanent ring magnets decrease with a decreasing spacing between adjacent pole shoes 1. This reduces the induction of the reversible magnetic field produced between the pole shoes 1. With a spacing between adjacent pole shoes 1 less than 30 to 40 mm and with the necessity to produce a high-induction reversible magnetic field, it is expedient that the radially magnetized permanent ring magnets 7 should be replaced by axially magnetized permanent magnets 13 (FIG. 5) shaped as parallelepipeds and interposed between rectangular pole shoes 14 (FIG. 5). In order to improve the uniformity of the reversible magnetic field, the permanent magnets arranged in the gap between pole shoes must be displaced in the aximuthal direction by 90° with respect to the permanent magnets 13 arranged in the next gap.

Figure 6:
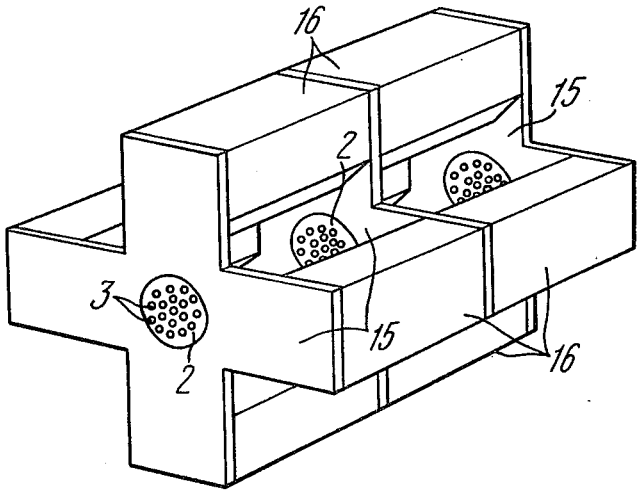
FIG. 6 is a schematic view of a reversible periodic magnetic focusing system in accordance with the invention with cross-shaped pole shoes.

In order to further increase the induction of the reversible magnetic field, the pole shoes are constructed as cross-shaped plates 15 (FIG. 6); four axially magnetized prism-shaped permanent magnets 16 are arranged between the ends of the cross. With the cross-section of the magnets shaped as a polyhedron, enough space is provided between adjacent permanent magnets 16 to locate power input and output means and provide a ready access to the resonator adjustment means.

Figure 7:
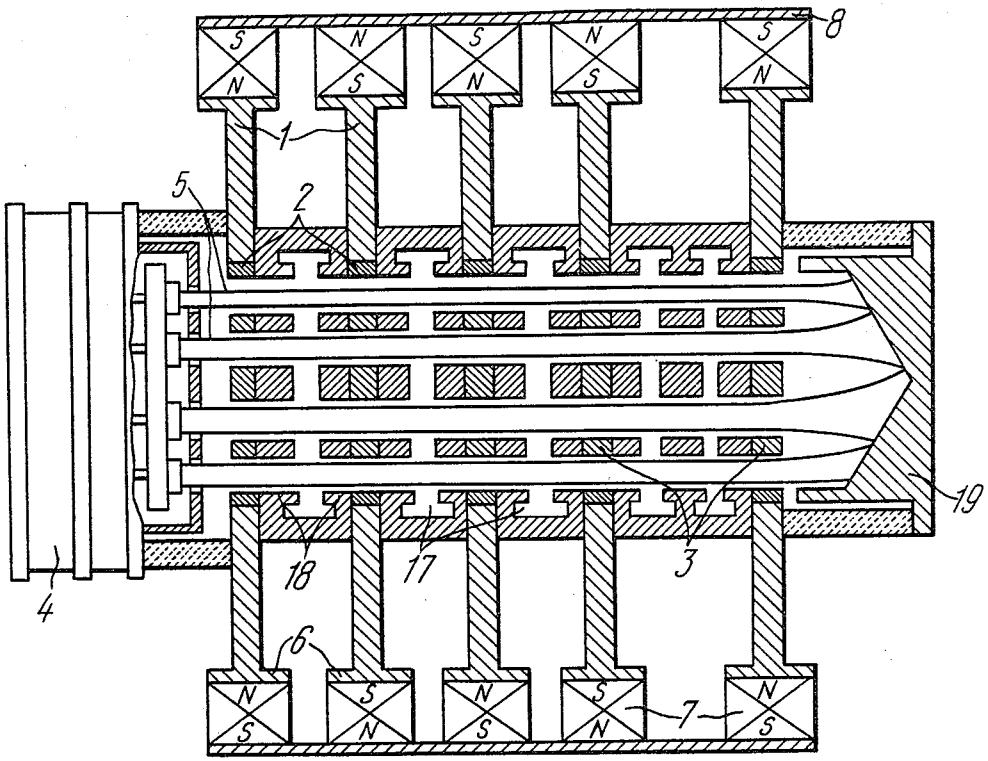
FIG. 7 is a schematic diagram of a klystron with a reversible periodic magnetic focusing system in accordance with the invention.

FIG. 7 refers to a reversible periodic magnetic focusing system according to the invention incorporated in a klystron. The klystron comprises an array of resonators 17 with flight-path tubes 18, having on one side the electron gun 4 and on the other side a collector 19. Interposed between the resonators 17 are the pole shoes 1 in which there are installed the grids 2 with the meshes 3, The latter are coaxial with the outlet holes of the electron gun 4 so that the electron beams 5 of the multi-beam electron flow produced by the gun 4 pass through the meshes 3. The radially magnetized permanent ring magnets 7 are mounted on the annular projections 6 of the pole shoes 1. The permanent magnets 7 are interconnected by the magnetic circuit 8.

The reversible periodic magnetic focusing system according to the invention operates as follows. The permanent ring magnets 7 produce a magnetic flux whose lines of force extend through the magnetic circuit 8, the pole shoes 1 and the grids 2 and produce a magnetic field in the flight-path tubes 18 of the resonators 17 arranged in the gaps between the pole shoes 1.

The adjacent pole shoes 1 are magnetized in the opposite sense, so that the magnetic field produced in the gaps between the pole shoes 1 is reversible.

If the diameter of the pole shoes 1, the spacing between the pole shoes 1, the height of the projections 6, the thickness of the grids 2 and the diameter of the meshes 3 are selected according to the above-mentioned ratios, the distribution of the magnetic field in each flight-path tube 18 is symmetric in relation to the symmetry axis of the tube 18. The diameter of the meshes 3 is relatively small; hence the extension of the reversal zone of the magnetic field is also limited.

Each electron beam 5 of the multibeam flow produced by the electron gun 4 is introduced into the axially symmetric reversible magnetic field with a limited reversal zone. If the perveance of each electron beam is relatively small (for example, $0.5 \cdot 10^{-6}$ $A/B^{3/2}$), the reversal zone of the magnetic field is too small to produce a significant defocusing of the electron beams 5 of the multibeam electron flow. As a result, the electron beams 5 are in no way affected by the reversal zone of the magnetic field and reach the collector 19 of the klystron unimpeded. With several tens of electron beams 5 (for example, with 50 beams) the total perveance of the electron flow being focused is about $25 \cdot 10^{-6}$ $A/B^{3/2}$.

To summarize, the reversible periodic magnetic focusing system according to the invention and the above-mentioned ratios between the dimensions of its components make it possible to increase the perveance of the electron flow to more than $25 \cdot 10^{-6}$ $A/B^{3/2}$, unlike conventional periodic magnetic focusing systems in which the perveance of the flow is about $1 \cdot 10^{-6}$ $A/B^{3/2}$.

COMMERCIAL APPLICABILITY

The invention can be used to design and manufacture compact, high-power UHF equipment, such as klystrons and travelling wave tubes. It is also applicable to charged particle accelerators and to various equipment, such as welding and melting equipment, which makes use of extended electron flows.

What is claimed is:

1. A reversible periodic magnetic focusing system to increase the perveance of the electron flow comprising:

a successive arrangement of permanent magnets magnetized in an opposite sense;

magnetically soft pole shoes interposed between the permanent magnets, each pole shoe having a hole for passage of an electron flow; and grids with meshes, receives in the holes of said pole shoes, said grids being of a magnetically soft material and having magnetic, thermal and electric contact with the pole shoes, the respective meshes of the grids of the pole shoes being arranged coaxially.

2. A reversible periodic magnetic focusing system as claimed in claim 1, wherein the pole shoes and the meshes are round, and annular projections on each side of said pole shoes, radially magnetized permanent ring magnets attached to said projections, and wherein the size and the thickness of the grids the distance between the pole shoes, the diameter of the meshes of the grids, the diameter of the pole shoes, and the dimensions of the projections are selected so as to meet the following conditions:

$$0.8 \leqq (a/t) \leqq 1.3;$$

$$1 \geqq (\tfrac{3}{4})R(B/B_1);$$
$$0.05 \leqq (h/L) \leqq 0.15;$$

$$(d/L) \leqq 0.6;$$

$$0.8 \leqq (D/L),$$

where a is the diameter of the meshes of the grids;

is the thickness of the grids;

l is the azimuthal distance between adjacent meshes which are spaced equidistantly from the centre of the pole shoes;

R is the distance between the centre of the mesh of the grid and the centre of the pole shoe;

B is the induction in the gap between the pole shoes;

$B_1$ is the maximum induction of the linear portion of the magnetization curve of the material of the pole shoes;

h is the height of the projections;

L is the distance between the pole shoes;

D is the outer diameter of the pole shoes.

3. A reversible periodic magnetic focusing system as claimed in claim 1, wherein each pole shoe is shaped as a polyhedron on whose faces there are radially mounted longitudinally magnetized permanent magnets shaped as parallelepipeds.

4. A reversible periodic magnetic focusing system as claimed in claim 1, wherein the grids of the pole shoes are honeycomb-structured grids with hexagon-shaped meshes.

5. A reversible periodic magnetic focusing system as claimed in claim 1, wherein the pole shoes are constructed as rectangular plates with two axially magnetized permanent magnets arranged between the plates, the permanent magnets being displaced in the azimuthal direction by 90° with respect to permanent magnets arranged in the next gap.

6. A reversible periodic magnetic focusing system as claimed in claim 1, wherein the pole shoes are constructed as cross-shaped permanent magnets with a polyhedral cross-section arranged between the ends of the cross.

7. A reversible periodic magnetic focusing system comprising:

a plurality of permanent magnets arranged successively and magnetized in the opposite sense;

a plurality of magnetically soft pole shoes, each pole shoe being interposed between a pair of permanent magnets, and each pole shoe having a hole therein for passage of an electron flow;

a plurality of grids constituted of magnetically soft material, said grids being receivable in said pole shoes such that they are in magnetic, thermal and electric contact with said pole shoes; and a plurality of meshes, a pre-determined number of said meshes being associated with each grid, the respective meshes of the grids being arranged coaxially.

8. The reversible periodic magnetic focusing system of claim 7, and additionally comprising annular projections positioned on each side of the pole shoes, and magnetized permanent ring magnets attached to the annular projections, and wherein the pole shoes, meshes, and grids are round and the size and thickness of the grids, the distance between the pole shoes, the diameter of the meshes of the grids, the diameter of the pole shoes, and the dimensions of the projections are all selected so as to meet certain pre-determined conditions.

9. The reversible periodic magnetic system of claim 8 wherein said pre-determined conditions are:

$$0.8 \leqq (a/t) \leqq 1.3;$$

$$1 \geqq (\tfrac{3}{4})R(B/B_1);$$

$$0.05 \leqq (h/L) \leqq 0.15;$$

$$(d/L) \leqq 0.6;$$

$$0.8 \leqq (D/L),$$

where a is the diameter of the meshes of the grids;

t is the thickness of the grids;

l is the aximuthal distance between adjacent meshes which are spaced equidistantly from the centre of the pole shoes;

R is the distance between the centre of the mesh of the grid and the centre of the pole shoe;

B is the induction in the gap between the pole shoes;

$B_1$ is the maximum induction of the linear portion of the magnetization curve of the material of the pole shoes;

h is the height of the projections;

L is the distance between the pole shoes;

D is the outer diameter of the pole shoes.

10. The reversible periodic magnetic focusing system of claim 7 wherein said meshes include a central mesh with the others displaced relative to the geometrical centers of said pole shoes.

11. The reversible periodic magnetic focusing system of claim 7 wherein the grids are honeycomb-structured and the meshes are hexagon-shaped.

12. The reversible periodic magnetic focusing system of claim 7 wherein the pole shoes are rectangular plates having two axially magnetized permanent magnets arranged therebetween, said permanent magnets being displaced in the aximuthal direction by 90° with respect to permanent magnets arranged in the next gap.

13. The reversible periodic magnetic focusing system of claim 7 wherein the pole shoes are cross-shaped plates, and wherein four axially magnetized prism-shaped magnets having a polyhedral cross section are arranged between the ends of the cross.

14. The reversible periodic magnetic system of claim 9 wherein said meshes include a central mesh with the others displaced relative to the geometrical centers of said pole shoes.

15. The reversible periodic magnetic focusing system of claim 9 wherein the grids are honeycomb-structured and the meshes are hexagon-shaped.

16. The reversible periodic magnetic focusing system of claim 9 wherein the pole shoes are rectangular plates having two axially magnetized permanent magnets arranged therebetween, said permanent magnets being displaced in the azimuthal direction by 90° with respect to permanent magnets arranged in the next gap.

17. The reversible periodic magnetic focusing system of claim 9 wherein the pole shoes are cross-shaped plates, and wherein four axially magnetized prism-shaped magnets having a polyhedral cross section are arranged between the ends of the cross.

* * * * *

UNITED STATES PATENT AND TRADEMARK OFFICE

CERTIFICATE OF CORRECTION

PATENT NO. : 4,433,270

DATED : February 21, 1984

INVENTOR(S) : Sergei S. DROZDOV, et al.

It is certified that error appears in the above—identified patent and that said Letters Patent is hereby corrected as shown below:

The following names should be added under Item [75].

Vitaly Izrailevich PASMANNIK
ulitsa Ostrovityanova 45,
Korpus 1, kv.569, Moscow, USSR Viktor Frantsevich FALTEISEK
Profso-Juznava ulitsa.60,
Korpus 2, kv.26, Moscow, USSR Jury Pavlovich FILIPPOV
ulitsa Kirovogradskaya, 28,
Korpus 1, kv.72, Moscow, USSR.

Signed and Sealed this

*Thirteenth* Day of *November 1984*

[SEAL]

*Attest:*

GERALD J. MOSSINGHOFF

*Attesting Officer*

*Commissioner of Patents and Trademarks*